US006160567A

United States Patent [19]

Feist

[11] Patent Number: 6,160,567

[45] Date of Patent: Dec. 12, 2000

[54] ELECTROSTATIC WRITE HEAD FOR ELECTRONIC PRINTING PRESS

[75] Inventor: Wolfgang Feist, Burlington, Mass.

[73] Assignee: Heidelberger Druckmaschinen AG, Heidelberg, Germany

[21] Appl. No.: 08/852,970

[22] Filed: May 8, 1997

[51] Int. Cl.[7] ..... B41J 2/39

[52] U.S. Cl. ..... 347/238; 347/112

[58] Field of Search ..... 347/128, 141, 347/142, 159, 162, 238, 115, 112

[56] References Cited

U.S. PATENT DOCUMENTS

| | | | |
|---|---|---|---|
| 4,792,860 | 12/1988 | Kuehnle . | |
| 4,841,313 | 6/1989 | Weiner | 347/128 |
| 4,992,807 | 2/1991 | Thomson . | |
| 5,159,358 | 10/1992 | Kubelik | 347/128 |
| 5,270,729 | 12/1993 | Stearns | 347/128 |
| 5,406,314 | 4/1995 | Kuehnle . | |
| 5,592,206 | 1/1997 | Watanabe et al. | 347/238 |

OTHER PUBLICATIONS

Hideyuki Nakao et al., "Solid State Ion Generator For Ion–Jet Head", Proceedings of IS&T's Eleventh International Congress on Advances In Non–Impact Printing Technologies (1995), pp. 522–524.

*Primary Examiner*—N. Le
*Assistant Examiner*—Lamson D. Nguyen
*Attorney, Agent, or Firm*—Kenyon & Kenyon

[57] ABSTRACT

An electrostatic write head for writing pixels on a print cylinder is disclosed in which a continuous wave radio-frequency source is applied to a radio-frequency electrode disposed on a first side of a dielectric body. A control electrode is disposed on the second side of the dielectric body. When the voltage at the radio-frequency electrode is sufficiently high, a plasma containing electrons, negatively charged ions and positively charged ions ignites near the second side of the dielectric body. While these conditions are maintained, a varying control signal is applied to the control electrode. When a print cylinder having a conducting reference electrode is brought near the plasma, the plasma contacts the surface of the print cylinder and causes it to become charged to a voltage which directly relates to the control signal, thus writing a charged pixel on the surface of the print cylinder.

13 Claims, 4 Drawing Sheets

ELECTROSTATIC WRITE HEAD FOR ELECTRONIC PRINTING PRESS

FIELD OF THE INVENTION

The present invention relates generally to miniature charging devices for applying a controlled amount of electrical charge to a receptor. More particularly, it relates to a write head for an electronic printing press.

RELATED TECHNOLOGY

Some charging devices employ a corona or "arc" discharge to generate charge carriers. Such devices suffer from highly localized and sporadic emissions of electrons from the cathode, which makes controlling the charging process difficult. Also, it is difficult to maintain a large plasma space charge density, thus reducing the possible cathode current density.

In other charging devices, charge carriers arc generated in a direct current ("d-c") glow mode plasma. While such devices create a denser, more conductive plasma than corona devices, such devices suffer from the fact that the cathode still must be exposed to the plasma. Due to the surface texture of the cathode, work-function variations, and edge effects, uneven current distributions and electric fields occur at the cathode surface. These uneven current distributions and electric fields cause a time-varying pattern of "hot spots" on the cathode surface, generally resulting in rapid erosion by sputtering and thermionic evaporation from these "hot spots." Furthermore, chemically reactive species generated in the plasma (particularly if the plasma is generated in air) can degrade or oxidize the exposed electrode. These effects can greatly shorten the life of such a device. Moreover, these devices typically require a controlled gas environment for proper plasma formation, including complicated gas delivery systems.

In still other charging devices, a radio-frequency discharge is used. The amount of charge transferred is controlled by controlling the length of time during which the discharge is ignited, as described in U.S. Pat. No. 4,992,807 assigned to Delphax Systems. This has the disadvantage of having to pulse the radio-frequency source, and repeatedly re-ignite and quench the plasma.

The Toshiba Corporation has also described an "Ion-jet" printing head using two electrodes on either side of a ceramic layer, in conjunction with an alternating voltage course. However, this printing head is used to deposit broad charges and is not a write head and cannot deliver individual charges corresponding to pixels. Moreover a separate control electrode is needed in addition to the two electrodes at the sides of the ceramic layer, and a control electrode is not provided directly on the ceramic layer.

SUMMARY OF THE INVENTION

The present invention generates charge carriers in a radio-frequency gas discharge. The electrode applying the radio-frequency (RF) signal is disposed on one side of a dielectric body, and the discharge is ignited on a second side. Thus, the RF electrode is not exposed to the plasma. A control electrode is provided on the second side of the dielectric body to cause a controlled amount of charge to be transferred to a receptor, such as a print cylinder in a printing press.

In the device of the present invention, a radio-frequency source is applied to a radio-frequency electrode disposed on a first side of a dielectric body to generate a plasma. A plurality of control electrodes are disposed on the second side of the dielectric body to write the proper charges.

When the voltage at the radio-frequency electrode is sufficiently high, a plasma containing electrons, negatively charged ions, and positively charged ions ignites near the second side of the dielectric body. As the plasma is maintained, control signals are applied to the plurality of control electrodes. The average voltage of the plasma in the vicinity of the control electrode will change by the amount of the control signal, but the condition of the plasma remains basically unaffected except for its potential relative to ground.

When a proper receptor is brought near the plasma, ions in the plasma are attracted to the receptor and cause it to become charged. The receptor for instance is a print cylinder having a dielectric layer backed by a grounded layer or layer charged to a constant voltage. The charging of the receptor continues until the receptor becomes charged to a potential which is closely related to that of the control electrode, at which point the charged ions in the plasma are no longer attracted in the direction of the receptor.

The device of the present invention advantageously and preferably may be used in an ordinary air environment at atmospheric pressure due to the excellent plasma formation created by the R-F electrode. However, it is also suitable for operation in a controlled gas atmosphere (such as argon, nitrogen, or mixtures with air). The use of an ordinary air environment greatly simplifies the write head, since using a controlled gas atmosphere, as necessary in some prior art devices, typically requires complicated gas delivery systems and leads to cross talk between control electrodes arranged next to one another. This cross talk is reduced or almost eliminated in an ordinary air environment because the free mean path of the plasma ions is rather short.

The charging devices advantageously but not necessarily are arranged in a side-by-side array. An array of such devices may find application as an electrostatic write head for use with a printing press. In such an application, the receptor would be the surface of a printing cylinder of the press. Such an array could be made which would write pixels on the printing cylinder with a pitch as small as approximately 50 $\mu$m and with a charging current density on the order of 1 mA/cm$^2$, suitable for fast electrostatic writing with grey scale at a speed on the order of 1 m/s.

DETAILED DESCRIPTION OF THE INVENTION

Figure 1:
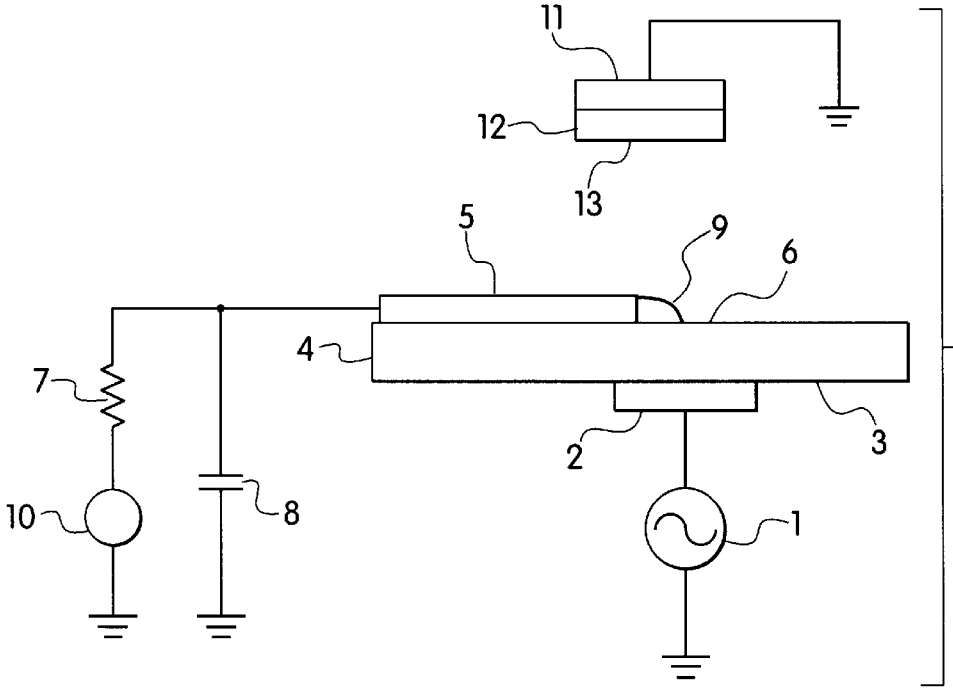
FIG. 1 is a cross-sectional view of an embodiment of the invention.

FIG. 1 shows a side view along the length of an embodiment of the present invention in which a continuous, typically sinusoidal radio-frequency source 1 of 800 to 3000 V peak-to-peak at 4 kHz to 1 MHz is applied to a radio-frequency electrode 2. Except for the contact to the radio frequency source 1, electrode 2 is encapsulated by, supported from or built on a suitable dielectric medium or insulating substrate (not shown) to prevent parasitic electronic discharges from the electrode. The radio-frequency electrode 2 is disposed along a first side 3 of a dielectric body 4, which is typically 10 $\mu$m to 100 $\mu$m thick. Preferably, the electrode 2 is disposed along the entire width of the dielectric body 4. A control electrode 5, typically 10 $\mu$m to 50 $\mu$m wide and one of a plurality of control electrodes, is disposed on the second side 6 of the dielectric body 4. The control electrode 5 is capacitively coupled to ground. Here, this coupling is represented schematically by capacitor 8, typically 3 to 100 pF. A resistor 7, for example having a resistance of one mega-ohm, may be used to protect a control signal source 10 from current surges. The control electrode 5 is positioned so as to just avoid overlapping, or more or less overlap the horizontal position of the radio-frequency electrode 2.

The dielectric body 4 should be free of pinholes and resistant to the formation of pinholes during operation. Pinholes in the dielectric body 4 might allow a strong direct current to flow thorough the dielectric body, disturbing the control mechanism and causing physical damage in the area of the pinhole. The dielectric body 4 may comprise layers of dielectric material since the layered construction prevents growth defects from propagating throughout the entire thickness of dielectric body 4. Natural mica, 30 $\mu$m thick and naturally having layers, has shown excellent durability even when the atmosphere used for the plasma is air. An artificial dielectric body 4 comprising one or several layers of dielectric material can be formed by the deposition or lamination the same dielectric material or alternating layers of different materials. Such dielectric materials might include KAPTAN-PR, a polyimide manufactured by the DuPont Corporation, glass, and standard other dielectric films, such as $SiO_2$ or $Al_2O_3$.

When the voltage at the radio-frequency electrode 2 is sufficiently high, a plasma 9 containing electrons and positively charged ions ignites near the second side 6 of the dielectric body 4. Preferably, the R-F electrode operates at 4 kHz to 400 kHz or above, at which frequency a steady plasma forms which can tolerate varying control voltages.

While these conditions are maintained, a control signal 10, typically ranging from −600 V to +600 V, is applied to control electrode 5. The d-c voltage across the dielectric body 4 in the vicinity of the control electrode 5 will change by the amount of voltage delivered by the control signal source 10, but the condition of the plasma 9 remains unaffected except for its potential relative to ground. Thus, little visible change occurs in the appearance of the plasma 9 (in extent, color, brightness, etc.) as the control signal 10 is applied.

The ground terminals of the radio frequency source 1 and the control signal source 10 are connected to the ground terminal of a conducting reference electrode 11 (typically a grounded layer) of a receptor 12 whose surface 13 is to be charged. This is representational of a print cylinder surface, for example. When the receptor 12 is brought near the plasma 9, the surface 13 becomes charged to a potential which is a function of that of the voltage at the control electrode 5. Under normal operating conditions, the actual potential of the receptor surface 13 will typically vary in a nearly linear relationship with the voltage applied to the control electrode 5, offset by an offset voltage.

As an example, if the offset voltage for a certain system is 30 volts, when a voltage of minus 30 volts is applied by the control signal source 10, the surface 13 will charge approximately to a potential of zero, or ground. If a voltage of 70 volts is applied by the control signal source 10, the surface 13 will charge to a potential of approximately 100 volts. The difference or offset voltage between control source voltage 10 and the delivered potential at the surface 13 advantageously is fairly constant within a voltage range of +/−300 volts. The offset voltage can be measured for a certain design, for example a printing press, and used to calculate the desired control signal voltages which must be delivered for a desired potential at the surface 13. If the offset voltage is constant, this calculation is a simple addition or subtraction step.

The charging device of the present invention therefore permits an accurate method of depositing a charge on a receptor over a wide range of voltages.

Figure 7:
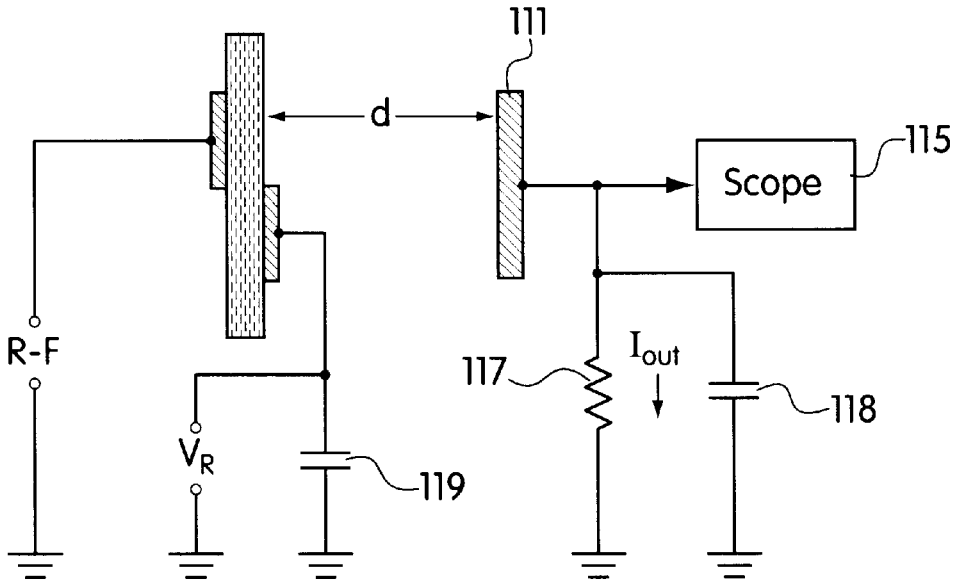
FIG. 7 shows a device for measuring the electronic properties of an electrostatic printing press system.

FIG. 7 shows schematically a setup for estimating the output current, $I_{OUT}$, of the charging device shown in FIG. 1 which is received on a surface at a certain distance d as shown. This setup can also be used to estimate the offset voltage discussed above. A test electrode 111 is attached to a scope 115 which then displays the output current through the resistor 117, which has for example a resistance of 100 kilo-ohms. A low capacitance capacitor 118 can also be coupled as shown, typically having a capacitance of 0.1 microfarads. As the control voltage $V_C$, coupled to ground with a capacitor 119 (for example with a capacitance ranging in size from 1000 pF to 1 $\mu$F), is varied while the R-F generator generates a plasma, the scope 115 measures the output current. In order to increase the output current to a level which is easier to measure, the test electrode width (into the page as shown in FIG. 7) may be increased to a width equal to a pixel width multiplied by a multiplying factor m, with a single control voltage being applied to a plurality of control electrodes. The output current for a single control electrode whose width is equal to a pixel width can then be estimated by dividing the measured output current by the factor m.

Figure 8:
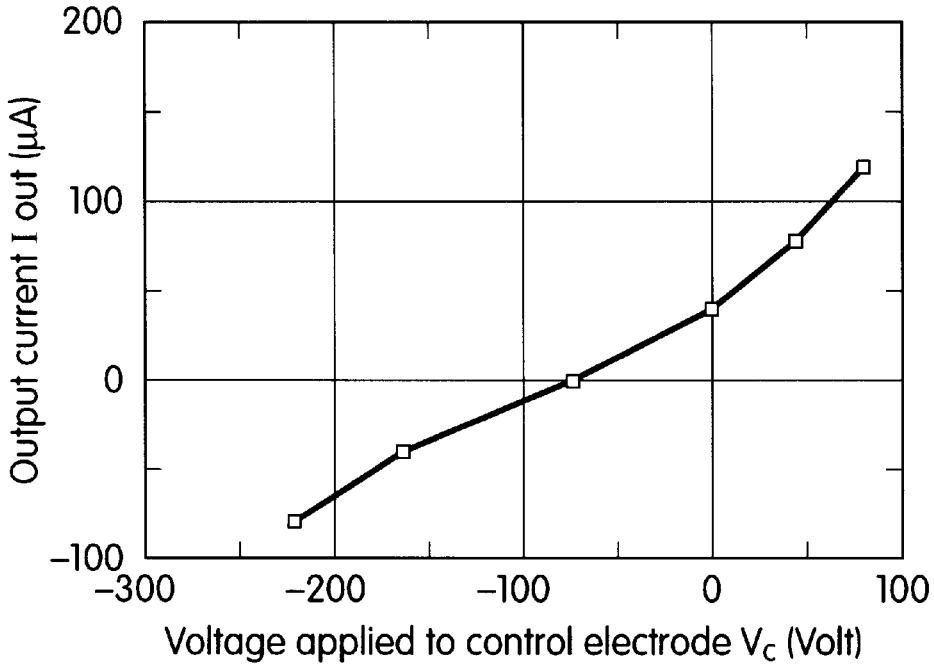
FIG. 8 shows the output characteristics of a simplified press system.

As shown in FIG. 8, the output current at a distance d of 0.25 mm varies almost linearly with the voltage applied to the control electrode 5. At a control voltage of −70 V, the output current is approximately zero, and would correspond to no charge being deposited on a receptor surface. Even higher output currents than shown are available if the distance, d, is reduced and/or the R-F voltage is increased. Of course, FIGS. 7 and 8 are being shown just as one simple example of how to measure the output of a charging device. Other possibilities, such as actually measuring the charge or potential deposited on the receptor surface and their time responses, are equally valid.

Figure 2:
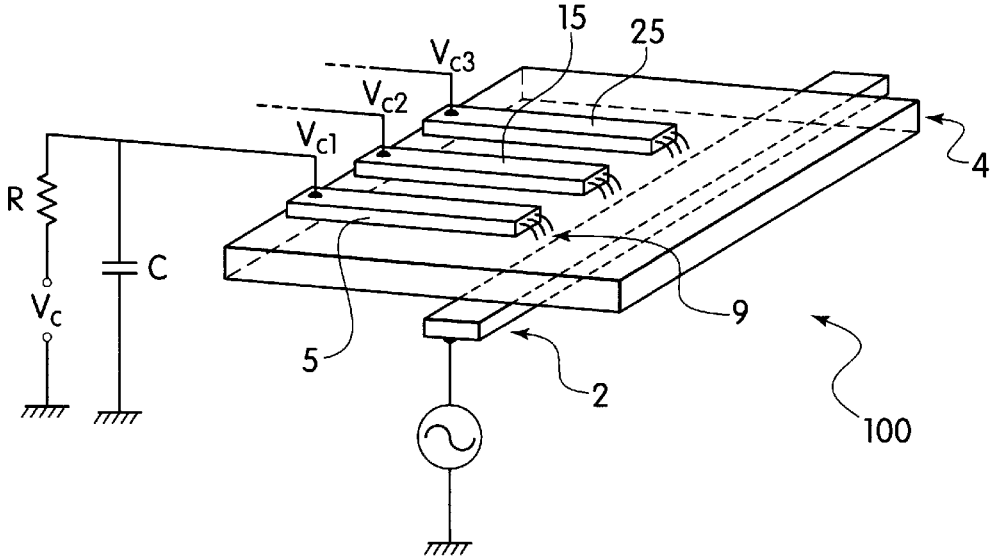
FIG. 2 is a top/side view of the embodiment of the invention shown in FIG. 1.

Referring to FIG. 2, the charging devices of the present invention are advantageously employed arranged in a side-by-side array for use as a write head 100 in a printing press. In this embodiment, a plurality of control electrodes 5, 15, and 25 are all arranged on the second side 6 of a single dielectric body 4. (While only three control electrodes are depicted in FIG. 2, it should be understood that this embodiment of the present invention is limited to no particular number of control electrodes, and that the number of control electrodes used could be any suitable number depending on the application desired.) Each of the control electrodes 5, 15, 25, etc. has an independent control signal $V_{C1}$, $V_{C2}$, $V_{C3}$, etc., respectively. A single radio-frequency electrode 2 fed by a radio-frequency source is disposed on the first side 3 of dielectric body 4 and spans across the width of the dielectric body 4 to provide a plasma for the plurality of control electrodes 5, 15, and 25 as shown. Typically, the faces of the control electrodes 5, 15, and 25 are oriented at a 90 degree angle from the radio-frequency electrode 2. In such an array of charging devices, cross-talk between the control electrodes 5, 15, and 25 may be reduced by providing isolating structures. For example, the control electrodes may be coated with a layer of dielectric material, leaving only the ends of the control electrodes nearest the plasma bare. However, when operating in an open air atmosphere, as preferred, such isolating structures may not even be necessary.

Figure 3:
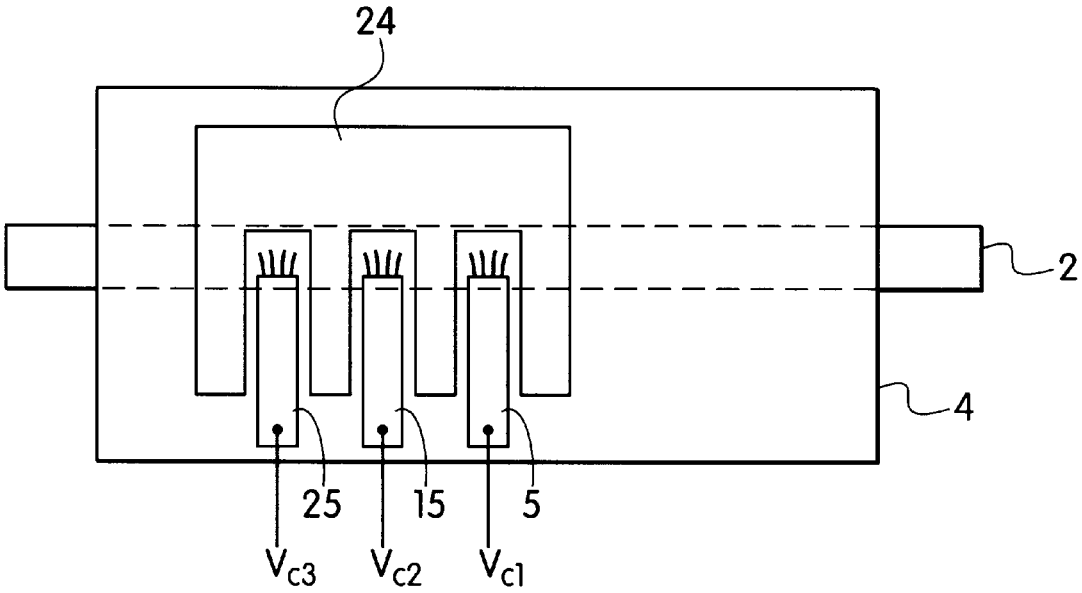
FIG. 3 is a top view of another embodiment of the invention.

Referring to FIG. 3, an open-ended isolating structure 24 is provided to reduce crosstalk between the control electrodes 5, 15, and 25. The open-ended isolating structure 24 may be a ridge of dielectric material. It also may be a conductive scoop or containment electrode, connected for example to a constant charged source to absorb or "scoop up" stray ions, or to contain the ion flow.

Figure 4:
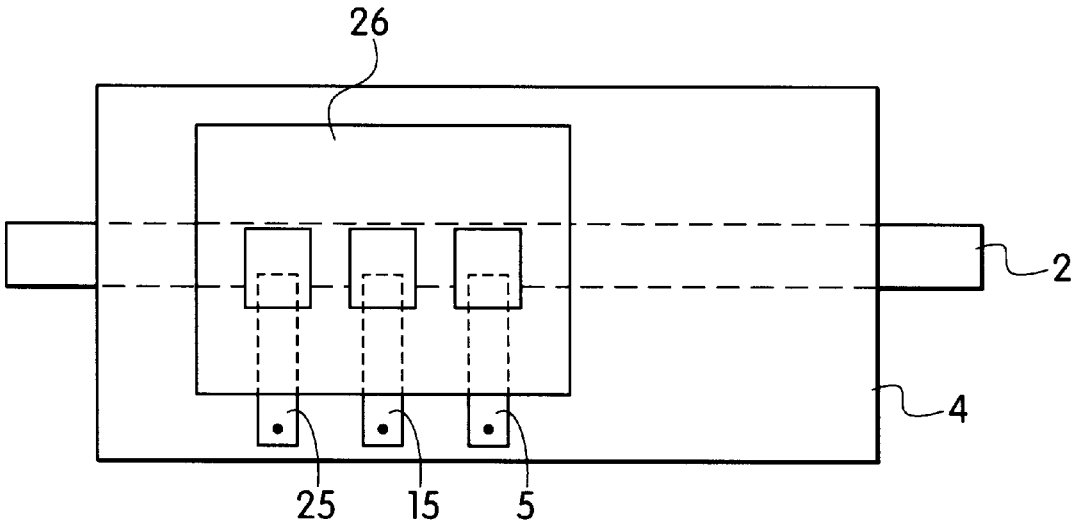
FIG. 4 is a top view of another embodiment of the invention.

Referring to FIG. 4, in another embodiment, a close-ended isolating or conducting structure 26 is provided. Again, the close-ended isolating structure 26 may be a ridge of dielectric material, or may be a scoop or containment electrode.

Figure 5:
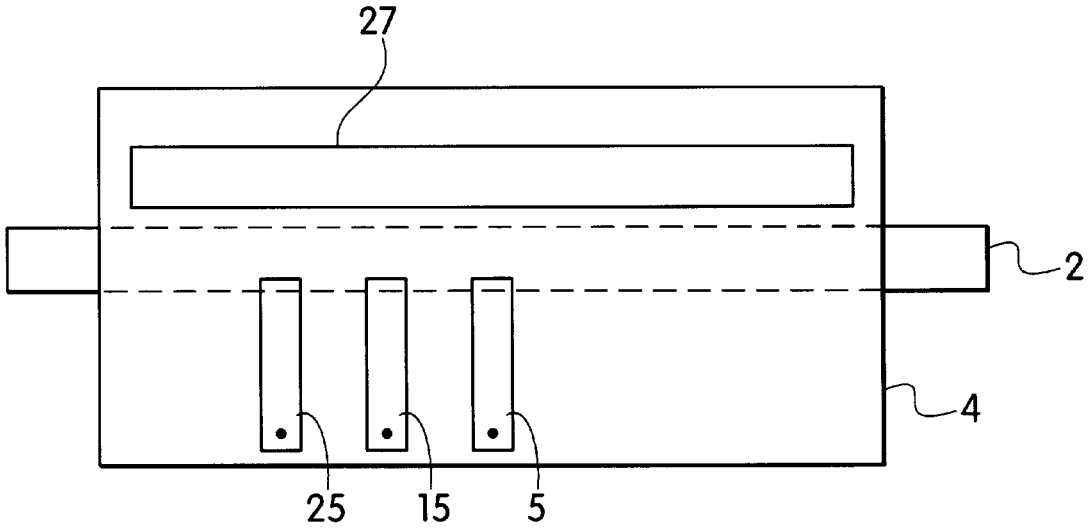
FIG. 5 is a top view of another embodiment of the invention.

Referring to FIG. 5, in another embodiment, a scoop or containment electrode 27 may be located opposite the ends of the control electrodes 5, 15, 25, again to reduce cross talk.

Figure 6:
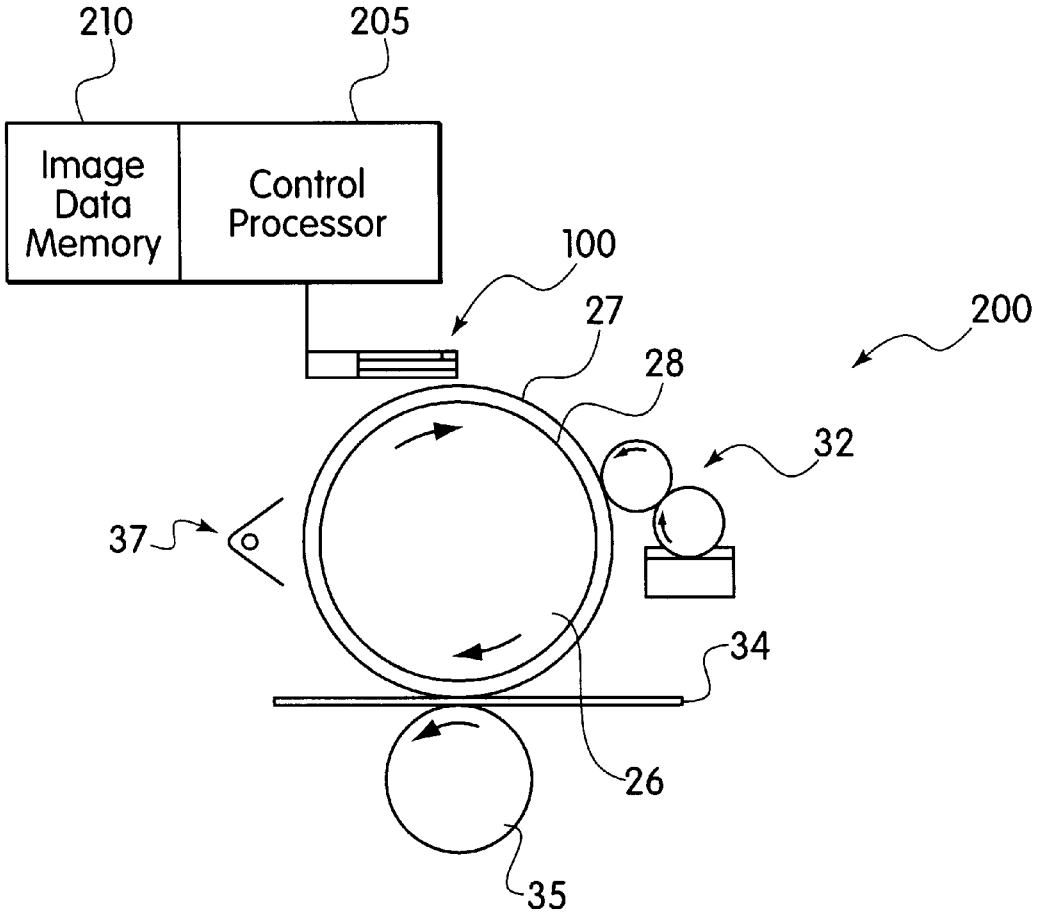
FIG. 6 is a view of an electrostatic printing press employing the device of this invention as a write head.

Referring to FIG. 6, the write head 100 of the present invention is shown as a component of an electrostatic printing press 200. A mass memory 210 can store data representing the image to be printed, including gray scale data. The processor 205 sets the proper voltage for each individual control electrode of the write head 100, according to the data representing the image to be printed. A print member, print cylinder 26, has a dielectric surface 27 which serves as a receptor. The dielectric surface 27 is backed by a conductive layer 28 which serves as a conducting reference electrode, and which may simply be a grounded layer, or may be a layer set by a control to a specific constant voltage. The write head 100 is disposed near the dielectric surface 27 of the print cylinder 26, with the individual control electrodes extending along the length of the write head 100. The write head 100 corresponds to that of the type shown in FIG. 2, so that the write head shown in FIG. 2 would be inverted so that the plasma 9 contacts the dielectric surface 27.

The print cylinder 26 rotates as shown. As it rotates, the dielectric surface 27 passes near write head 100. The control processor 205 sends control signals to the plurality of control electrodes contained in write head 100 to write charged pixels on the dielectric surface 27 of the print cylinder 26 through contact with the plasma so as to create a latent image. After the dielectric surface 27 passes write head 100 and receives charges therefrom, it passes an ink source 32. In FIG. 6, the ink source 32 is two ink rollers connected to an ink well, but any other suitable ink source may be used. Ink as defined herein includes liquid inks as well as dry toners. Ink from the ink source 32 is electrostatically attracted to the charged pixels in a quantity controlled by the voltage of the pixels. After receiving ink, the dielectric surface 27 comes into contact with a printing substrate 34, for example, a web or sheet of paper. The printing substrate 34 may be held in a suitable position for contact with the dielectric surface 27 by an impression cylinder 35. At the point of contact, the ink is transferred onto the printing substrate 34, resulting in the printing of the image 36 on the substrate. The dielectric surface 27 then passes an erasing means 37, such as an ultraviolet light source.

U.S. Pat. No. 5,406,314 to Kuehnle and U.S. Pat. No. 4,792,860 to Kuehnle also describing printing presses are hereby incorporated by reference herein.

It should be understood that the present invention may also be used for nay electrostatic printing press, which as defined herein includes copiers and facsimile machines, and also includes a four color press where each of the four print cylinders has a write head, the four write heads controlled by a common control processor.

What is claimed is:

1. An electrostatic printing press comprising:

a print member having a dielectric surface;

a write head for selectively writing charges on the dielectric surface of the print member comprising:

a dielectric body having a first side and a second side;

a radio-frequency electrode disposed on the first side of the dielectric body which receives a continuous, non-pulsed radio-frequency signal so that a plasma emerges at the second side of the dielectric body;

a plurality of control electrodes disposed on the second side of the dielectric body for receiving control signals, at least one control electrode being in electrical contact with the dielectric surface of the print member through the plasma; and a control process connected to the plurality of control electrodes for individually controlling the plurality of control electrodes.

2. The electrostatic printing press as recited in claim 1 further comprising a source of ink for bringing ink into contact with the dielectric surface of the print member.

3. The electrostatic printing press as recited in claim 1 wherein the print member further comprises a conductive layer underneath the dielectric surface, the conductive layer being more electrically conductive than the dielectric surface.

4. The electrostatic printing press as recited in claim 1 further comprising a coating of dielectric material on at least one of the plurality of control electrodes.

5. The electrostatic printing press as recited in claim 1 further comprising an isolating structure disposed at the second side of the dielectric body.

6. An electrostatic printing press comprising:

a print member having a dielectric surface;

a write head for selectively writing charges on the dielectric surface of the print member comprising:

a dielectric body having a first side and second side;

a radio-frequency electrode disposed on the first side of the dielectric body for receiving a radio-frequency signal so that a plasma emerges at the second side of the dielectric body; and a plurality of control electrodes disposed on the second side of the dielectric body for receiving control signals, at least one control electrode being in electrical contact with the dielectric surface of the print member through the plasma;

a control processor connected to the plurality of control electrodes for individually controlling the plurality of control electrodes; and an isolating structure disposed at the second side of the dielectric body, the isolating-structure being a scoop or containment electrode.

7. An electrostatic printing press, comprising:

a print member having a dielectric surface;

a write head for selectively writing charles on the dielectric surface of the print member comprising:

a dielectric body having a first side and a second side, a radio-frequency electrode disposed on the first side of the dielectric body for receiving a continuous, non-pulsed radio-frequency signal so that a plasma emerges at the second side of the dielectric body, and a plurality of control electrodes disposed on the second side of the dielectric body for receiving control signals, at least one control electrode being in electrical contact with the dielectric surface of the print member through the plasma;

a control process connected to the plurality of control electrodes for individually controlling the plurality of control electrodes; and an isolating structure disposed at the second side of the dielectric body, the isolating structure being a dielectric ridge.

8. The electrostatic printing press as recited in claim 1 wherein the print member is a cylinder.

9. An electrostatic write head for selectively delivering charges:

a dielectric body having a first side and a second side;

a radio-frequency electrode disposed on the first side of the dielectric body which receives a continuous, non-pulsed radio-frequency signal so that a plasma containing a plurality of charge carriers emerges at the second side of the dielectric body; and a plurality of individually controllable control electrodes disposed on the second side of the dielectric body for receiving control signals so that at least one control electrode electrically influences the plasma.

10. The electrostatic write head as recited in claim 9 further comprising a dielectric coating on at least one of the plurality of control electrodes.

11. The electrostatic write head as recited in claim 9 further comprising an isolating structure disposed at the second side of the dielectric body.

12. An electrostatic write head for selectively delivering charges, comprising:

a dielectric body having a first side and a second side;

a radio-frequency electrode disposed on the first side of the dielectric body for receiving a continuous, non-pulsed radio-frequency signal so that a plasma containing a plurality of charge carriers emerges at the second side of the dielectric body;

a plurality of individually controllable control electrodes disposed on the second side of the dielectric body for receiving control signals so that at least one control electrode electrically influences the plasma; and an isolating structure such that crosstalk between the control electrodes is reduced, the isolating structure being a scoop or containment electrode.

13. An electrostatic write head, comprising:

a dielectric body having a first side and a second side;

a radio-frequency electrode disposed on the first side of the dielectric body for receiving a continuous, non-pulsed radio-frequency signal so that a plasma containing a plurality of charge carriers emerges at the second side of the dielectric body;

a plurality of individually controllable control electrodes disposed on the second side of the dielectric body for receiving control signals so that at least one control electrode electrically influences the plasma; and an isolating structure which reduces cross-talk between the control electrodes, the isolating structure being a dielectric ridge.

* * * * *